United States Patent [19]

Fränkle

[11] Patent Number: 4,676,876

[45] Date of Patent: Jun. 30, 1987

[54] METHOD FOR MANUFACTURING COMPONENTS SUCH AS HEAT EXCHANGERS, HEAT ABSORBERS, ROCKET ENGINES OR THE LIKE

[75] Inventor: Helmut Fränkle, Unterhaching, Fed. Rep. of Germany

[73] Assignee: Messerschmitt-Bölkow-Blohm GmbH, Munich, Fed. Rep. of Germany

[21] Appl. No.: 877,114

[22] Filed: Jun. 23, 1986

[30] Foreign Application Priority Data

Jun. 27, 1985 [DE] Fed. Rep. of Germany ..... 3522958

[51] Int. Cl.[4] ..... C25D 1/02

[52] U.S. Cl. ..... 204/9

[58] Field of Search ..... 204/9

[56] References Cited

FOREIGN PATENT DOCUMENTS 1751691 1/1973 Fed. Rep. of Germany ..... 204/9

3315407 10/1984 Fed. Rep. of Germany ..... 204/9

*Primary Examiner*—T. M. Tufariello

*Attorney, Agent, or Firm*—Kenyon & Kenyon

[57] ABSTRACT

A method for the manufacture of components such as heat exchangers, heat absorbers, rocket engines and the like, the components substantially comprising a base structure having cooling canals which are covered by a cover layer of the same or technologically similar material and which is applied by electroplating in such a manner that the cooling canals are first provided with an electrically conducting filler, the cover layer being generated by electroplating and subsequently the filling of the cooling canal being removed. Flexible and elastically expandable profiled ropes which are inserted loosely into the cooling canals and are pulled out after the cover layer is electroplated on are provided as the filler for the cooling canals.

6 Claims, 2 Drawing Figures

METHOD FOR MANUFACTURING COMPONENTS SUCH AS HEAT EXCHANGERS, HEAT ABSORBERS, ROCKET ENGINES OR THE LIKE

BACKGROUND OF THE INVENTION

The present invention relates to a method for manufacturing components such as heat exchangers, heat absorbers, rocket engines or the like.

According to German Pat. No. 1 751 691, rocket engines are known which consist substantially of a base structure or an inside wall of highly conducting material, especially copper, into which longitudinally extending cooling canals are milled which are covered by an outer wall, likewise of highly conductive material, especially copper, by means of electroplating. This is done in such a manner that, after the cooling canals are milled, the latter are filled with a wax which is superficially made electrically conducting, the outer wall is then electroplated on and the wax is subsequently melted out.

It has, however, been found in practice that melting out the filler material is not without problems inasmuch as the wax, when heated, expands more than the base material, whereby a deformation and formation of cracks can come about between the base structure and the electroplated-on copper layer.

In order to avoid this danger, it is further known from DE-OS No. 33 15 407, to place relatively thin plastic ropes into the longitudinally extending cooling canals before the latter are filled with wax, the ends of which protrude from the cooling canals. Before the wax is melted out, these plastic ropes are removed by pulling them out, whereby cavities are obtained in the wax filling, into which the wax can expand when it is warmed up, without stressing the rocket engine structure by pressure.

DE-OS No. 30 11 282 furthermore describes a method for manufacturing heat absorbers, the cover layer of which, produced by electroplating, is provided with convex raises above the cooling canal so that the expansions caused from the side of the cover layer during the operation as the consequence of direct heat absorption can be taken up more advantageously.

The known methods for the design and production of such wall structures, especially for removing the filling for the cooling canal, are either accompanied by danger for the safety of the wall structure or are time-consuming and economically expensive. It is therefore an object of the invention to propose a method and a filler for the cooling canal which can be used in carrying out the method which assures electroplating of the cover layer on the base structure without problems as well as an easy and reliable removal of the cooling canal filling and which is at the same time simple to handle from an installation point of view, and also technically economical.

SUMMARY OF THE INVENTION

The above and other objects of the present invention are achieved by the provision that flexible and elastically stretchable profiled ropes are provided as the filling for the cooling canals, the ropes being loosely inserted into the canals before the cover layer is electroplated on and being pulled out after the cover layer is formed while their cross section is decreased.

In a further embodiment of the invention, if the cooling canals have a rectangular cross section, for the purpose of obtaining an arched cover layer over the cooling canals, ropes of circular cross section with a diameter larger than the width of the cooling canals are inserted therein. When the ropes with these dimensions are inserted into the cooling canals, they are arched above the upper edge of the cooling canals.

It is a further design feature of the invention to provide the ropes which are to be inserted into the cooling canals before the cover layer is electroplated with a recess toward the cover layer for tensionally receiving a highly heat-conducting body or rod of metal, especially consisting of the same material as the cover layer, where these rods are firmly joined to the cover layer when the cover layer is being made by electroplating.

Thereby, the heat exchanger area to the coolant flowing through is advantageously increased. It is further within the scope of the invention to make the ropes of a sponge rubber which has the properties necessary for carrying out the method according to the invention. The ropes are provided at least toward the cover layer with an electrically conducting layer which is made easily detachable from the electroplated-on cover layer for pulling out the ropes.

The invention permits a simple solution of the stated problem without difficulties. The ropes make it possible to quickly fill the cooling canals before the cover layer is electroplated on, in that the ropes need to be inserted only with a loose fit. The main problem within the scope of the invention, namely, the removal of the filler material and in this case of the ropes after the cover layer is electroplated, is likewise achieved in a simple manner by pulling out the ropes whereby the cross section of the latter decreases due to their elastic property and can thus be removed without sticking to the wall. Furthermore, the ropes can serve for the arrangement and temporary support of heat conducting bodies or rods.

BRIEF DESCRIPTION OF THE DRAWINGS

The invention will now be explained in greater detail in the following detailed description with reference to the drawings, in which.

DETAILED DESCRIPTION

Figure 1:
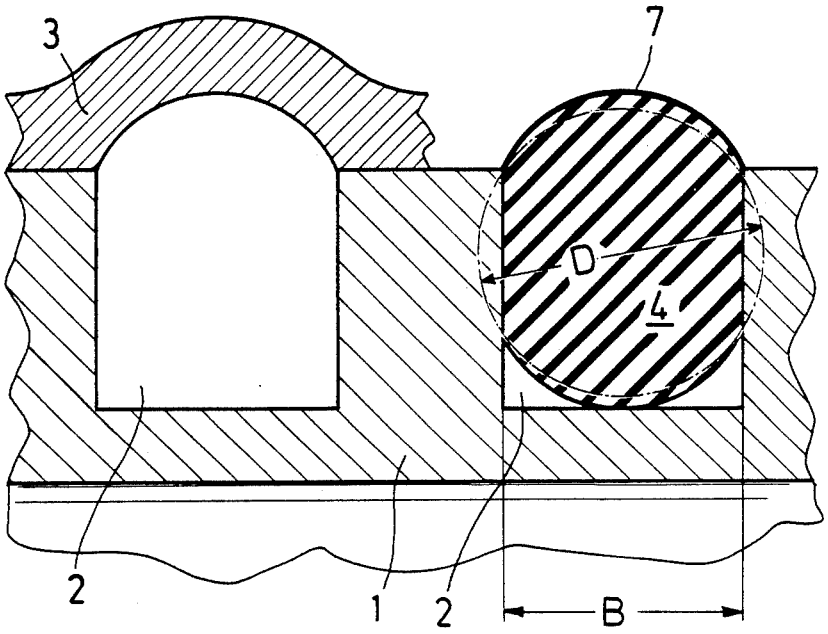
FIG. 1 shows part of the wall of a cylindrical heat absorber in a longitudinal section.

With reference now to the drawings, the wall of the heat absorber consists on the one hand of a base structure 1, into which transversely extending cooling canals 2 with rectangular cross section are provided. Into the cooling canals 2, flexible and elastically expandable profiled ropes 4 are inserted before a cover layer 3 is formed. In the case shown, the ropes 4 have circular cross section, the diameter D of which is larger than the width B of the cooling canals 2, as indicated. Thereby the rope 4 is compressed laterally and is arched convexly upward. At least outwardly, the rope 4 is made with an electrically conducting layer 7. The cover layer 3 is then electroplated on to the layer 7. After the latter is generated, the rope 4 is pulled out, whereby its cross section is reduced, the adhesion to the wall being reduced or eliminated.

Figure 2:
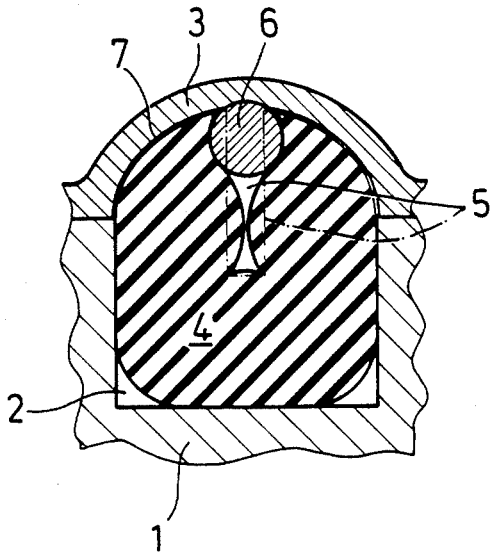
FIG. 2 shows a further possible embodiment within the scope of the invention.

In FIG. 2, the rope 4 has an outwardly-pointing longitudinal section 5 into which a rod 6 of metal is inserted, especially of the same material as the cover layer 3. When the cover layer 3 is electroplated, the rod 6 is firmly connected thereto. Subsequently, the profiled rope 4 is pulled out of the cooling canal 2.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A method for manufacturing a component adapted for the exchange of heat, said component substantially comprising a base structure of highly heat-conductive material having a cooling canal provided therein through which a coolant flows and which is covered by a covering layer of the same or technologically similar material to the material of the base structure, the method comprising providing the cooling canal with an electrically conducting filler or a filler which is superficially made electrically conducting, the covering layer being thereafter generated by electroplating on the filler, the cooling canal filler being subsequently removed, said step of providing the filler comprising the step of loosely inserting a flexible and elastically stretchable profiled rope as a filler into the cooling canal prior to the electroplating of the covering layer and further comprising the step of pulling the rope out of the cooling canal after the covering layer is electroplated thereon, the cross section of the rope being reduced as it is pulled out.

2. The method recited in claim 1, wherein the cooling canal has a rectangular cross section, said step of providing the filler comprising inserting a rope having a circular cross section into the canal for obtaining a covering layer arched over the cooling canal, said rope having a diameter larger than the width of the cooling canal, the rope being convexly raised above the upper edge of the cooling canal.

3. The method recited in claim 1, further comprising the step of providing the rope adjacent the cover layer with a recess for tensionally receiving a highly heat-conducting body of metal comprising the same or similar material as the covering layer, said body being firmly joined to the covering layer by electroplating when said covering layer is electroplated onto said rope.

4. The method recited in claim 1, wherein said step of providing comprises providing a rope comprising one of sponge rubber, silicone or another stretchable material having at least toward the covering layer an electrically conducting layer which is designed so as to be easily detachable from the electroplated covering layer for facilitating pulling out the rope.

5. The method recited in claim 3 wherein said step of providing the rope adjacent the cover layer with a recess for tensionally receiving a highly heat-conducting body comprises the step of providing the rope adjacent the cover layer with the recess for tensionally receiving a highly heat-conducting body comprising a rod of metal comprising the same or similar material as the covering layer.

6. The method recited in claim 1 which comprises a method for manufacturing a component adapted for the exchange of heat which comprises one of a heat exchanger, heat absorber or a rocket engine.

* * * * *